US005495136A

United States Patent [19]

Chiang et al.

[11] Patent Number: 5,495,136

[45] Date of Patent: * Feb. 27, 1996

[54] ILLUMINATING SYSTEM

[75] Inventors: Lee Chiang, Sylmar; William R. Ratcliffe, Thousand Oaks, both of Calif.

[73] Assignee: Marpole International Inc., Kowloon, Hong Kong

[ * ] Notice: The portion of the term of this patent subsequent to Feb. 23, 2010, has been disclaimed.

[21] Appl. No.: 226,938

[22] Filed: Apr. 13, 1994

Related U.S. Application Data

[63] Continuation of Ser. No. 978,528, Nov. 19, 1992, abandoned, which is a continuation of Ser. No. 822,742, Jan. 21, 1992, Pat. No. 5,188,447.

[51] Int. Cl.[6] ..... H01L 41/08

[52] U.S. Cl. ..... 310/339; 310/317; 310/319; 36/137; 362/103

[58] Field of Search ..... 310/317, 319, 310/338, 339; 36/137; 362/103

[56] References Cited

U.S. PATENT DOCUMENTS

| | | | |
|---|---|---|---|
| 3,701,903 | 10/1972 | Merhar | 310/339 X |
| 4,499,394 | 2/1985 | Koal | 310/338 X |
| 4,748,366 | 5/1988 | Taylor | 310/339 X |
| 4,814,661 | 3/1989 | Ratzlaff et al. | 310/339 X |
| 4,824,107 | 4/1989 | French | 310/800 X |
| 4,848,009 | 7/1989 | Rodgers | 36/137 |
| 4,896,069 | 1/1990 | Rosenberg et al. | 310/339 |
| 4,904,222 | 2/1990 | Gastgeb et al. | 310/800 |
| 4,943,752 | 7/1990 | Todd et al. | 310/339 |
| 5,188,447 | 2/1993 | Chiang et al. | 362/103 |
| 5,285,586 | 2/1994 | Goldston et al. | 36/137 |

FOREIGN PATENT DOCUMENTS

| | | | |
|---|---|---|---|
| 0121026 | 12/1983 | European Pat. Off. | 310/339 |
| WO87/02846 | 5/1987 | WIPO | 310/339 |

*Primary Examiner*—Mark O. Budd

*Attorney, Agent, or Firm*—Ellsworth R. Roston; Charles H. Schwartz

[57] ABSTRACT

A member made from a suitable material such as a polyurethane epoxy designed to withstand impact against an object is provided as a support member. For example, the member may constitute an insert disposed on or in the heel of a shoe but a wide variety of other applications are possible. A suitable member such as a piezoelectric member is disposed on the support member to produce a signal when the support member is impacted against the object or when the impact is released. This signal is amplified by an amplifier which is powered by a suitable source such as a battery. The amplified signals are introduced to a light emitting member such as a light emitting diode which provides an illuminated indication of the impact of the support member against the object. A member such as a resistance may be disposed in the circuit with the battery and the amplifier to limit the current flow through the amplifier during the times that the piezoelectric member is energized.

19 Claims, 1 Drawing Sheet

FIG. 1
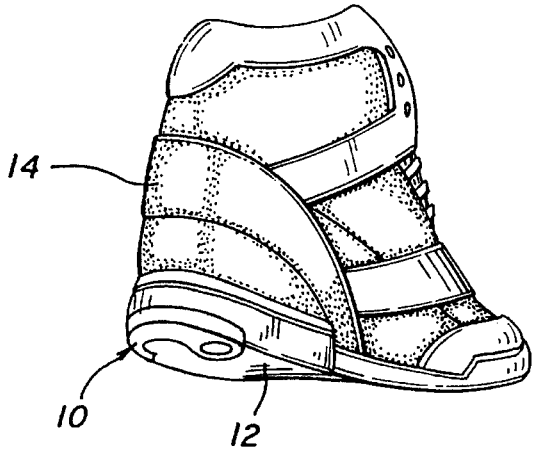
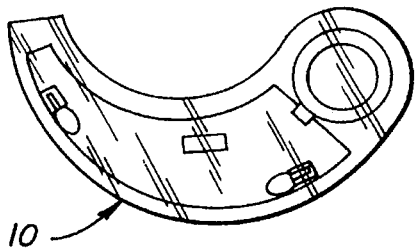
FIG. 2
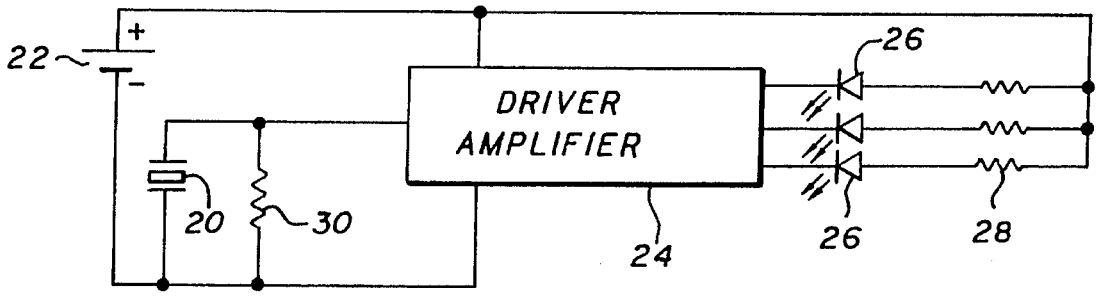
FIG. 3
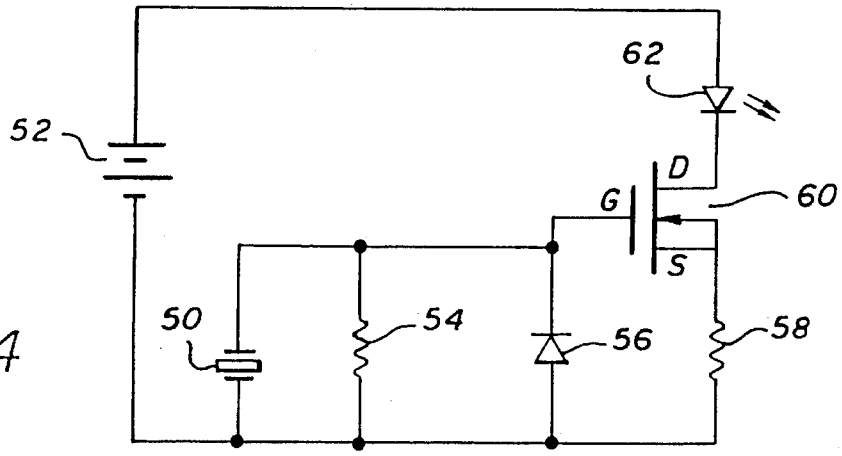
FIG. 4

ILLUMINATING SYSTEM

This is a continuation of application Ser. No. 07/978,528 filed Nov. 19, 1992, now abandoned, which in turn is a continuation of application Ser. No. 07/822,742 filed Jan. 21, 1992 (now U.S. Pat. No. 5,188,447).

This invention relates to systems for providing a visual indication of the impact of a support member against an object. The invention has particular utility in providing the visual indication at the support member immediately after the impact of the support member against the object.

Brisk walking, jogging and running have become commonly accepted as ways of exercising and of providing an effective weight control. In the United States alone, brisk walking, jogging and running are regularly under-taken by millions of people who are interested in preserving their health. In confirmation of this, millions of pairs of jogging and running shoes are sold each year under a wide variety of different brand names.

Walking, jogging and running generally occur in the early morning before the commencement of the day's business activities or in the evening after the completion of the day's business activities. Particularly in the fall, winter and spring, the walking, jogging and running often occur under adverse lighting conditions such as at dawn or at dusk. Furthermore, the walking, jogging and running frequently occur under other conditions less than desirable such as on the shoulders of roads traversed by automobiles. Running, jogging and walking accordingly often represent a certain amount of personal risk.

The adverse conditions discussed in the previous paragraph have been recognized for some time. Attempts have been made, and moneys have been expended, to overcome the adverse conditions discussed in the previous paragraph and to make it safe for running, jogging and walking to take place safely under all possible combinations of adverse conditions. In spite of such efforts and such money expenditures, the problems discussed in the previous paragraph still persist.

This invention provides a system which overcomes the problems discussed in the previous paragraphs. For example, the system may be incorporated in an insert attached to the heel of a shoe to provide an illumination every time that the heel of the shoe contacts the ground when the wearer of the shoe is walking, jogging or running. This illumination indicates to people in the vicinity of the wearer that the wearer is nearby. It accordingly helps to protect the wearer against injury. It will be appreciated that the disposition of the system on a heel insert is only one example, among many, in which the system of this invention can be used.

In one embodiment of the invention, a member made from a suitable material such as a polyurethane glass epoxy designed to withstand impact against an object is provided as a support member. For example, the member may constitute an insert disposed on the heel of a shoe but a wide variety of other applications is possible. A suitable member such as a piezoelectric member is disposed on the support member to produce a signal when the support member is impacted against the object. This signal is amplified by an amplifier which is powered by a suitable source such as a battery.

The amplified signals are introduced to a light emitting member such as a light emitting diode which provides an illuminated indication of the impact of the support member against the ground. A member such as a resistance may be disposed in the circuit with the battery and the amplifier to limit the current flow through the amplifier during the times that the piezoelectric member is energized.

In the drawings:

FIG. 1 is a schematic perspective view of a shoe and a heel insert incorporating one embodiment of the invention;

FIG. 2 is an enlarged plan view of the insert included in the shoe shown in FIG. 1.

FIG. 3 is a circuit diagram of a system which can be incorporated into the heel insert to provide an illumination every time that the heel insert impacts on the ground; and FIG. 4 is a circuit diagram of a second embodiment of the invention.

In one embodiment of the invention, a heel insert generally indicated at 10 in FIGS. 1 and 2 is adapted to be disposed on the heel 12 of a shoe generally indicated at 14 to provide an illumination every time that the heel of the shoe impacts on the ground. The heel insert 10 probably has a thin flat configuration corresponding substantially to the configuration of the heel 12. The insert 10 may be made from a suitable material such as a glass epoxy to withstand the impact of the heel 12 of the shoe 14 on the ground.

A circuit such as shown in FIG. 3 is adapted to be disposed in the heel insert 10 such as in printed circuit form. This circuit includes a piezoelectric member 20 which may be a type Kyocera KD 13. One terminal of the member 20 is connected to the negative terminal of a power supply such as a battery 22 to ground terminals in a driver-amplifier 24 which may be a chip designated as MC14049UBCD manufactured by Motorola. The positive terminal of the battery 22 is connected to a terminal of the driver-amplifier 24. A resistance 30 having a suitable value such as approximately one (1) megohm is connected between the opposite terminals of the piezoelectric member 20 and between input terminals of the driver-amplifier 24 and the negative terminal of the battery 22. The negative half cycles of the piezo electric member 20 outputs are shorted by an internal diode of the driver-amplifier 24.

First terminals of light-emitting diodes 26 are connected to the output of the driver-amplifier 24. Second terminals of the light-emitting diodes 26 are connected to one terminal of resistances 28. Second terminals of which the resistance 28 are connected to the positive terminal of the battery 22. Although three-light emitting diodes are shown in FIG. 3, it will be appreciated that any desired number of light-emitting diodes may be included in the circuit.

When the heel insert 10 impacts on the ground, it produces a strain in the piezoelectric member 20. This causes the piezoelectric member 20 to produce a signal which is introduced to the driver-amplifier 24 and is amplified by the driver-amplifier. The amplified signal causes the light-emitting diodes 26 to be energized so that light is emitted by the diodes. The light from the diodes 26 causes the heel insert 10 to become illuminated upon impact with the ground or upon release of the impact. This provides an indication of the location of the walker, jogger and runner to people in the vicinity. It accordingly enhances the safety of the walker, jogger or runner.

It will be appreciated that the heel insert 10 is only one of many applications of this invention. For example, the system of this invention can be used as a safety unit on a bicycle to provide an illumination as the spokes of the bicycle wheel impact on a support member corresponding to the heel insert 10. The system of this invention can even be disposed on a ball which becomes illuminated when the ball impacts against a wall or the ground or any other surface.

FIG. 4 shows another embodiment of the invention. The embodiment shown in FIG. 4 includes a piezoelectric member 50 corresponding to the piezoelectric member 20 in 18 FIG. 3 and also includes a voltage source such as a battery 52 corresponding to the battery 22 shown in FIG. 3. One terminal of the piezoelectric member 50 is connected to the negative terminal of the battery 52, to a first terminal of a resistance 54 having a suitable value such as approximately one (1) megohm, to the anode of a diode 56 and to a first terminal of a resistance 58 having a suitable value such as approximately 82 ohms.

The other terminal of the piezoelectric member 50 has a common connection with the second terminals of the resistance 54, with the cathode of the diode 56 and with the gate of a transistor 60, which may be an n- channel Mosfet transistor. The source of the transistor 60 is common with the second terminal of the resistance 58. A connection is made from the drain of the transistor 60 to one terminal of a light-emitting diode 62, the other terminal of which is connected to the positive terminal of the battery 52. Although only one light emitting diode 62 is shown, it will be appreciated that a plurality of light-emitting diodes connected in parallel may be used.

When the piezoelectric member 50 is energized by impact of a support member such as the heel insert 10 on the ground, it produces a signal. The negative half cycles of such signal are shorted by the diode 56. The positive half cycles of such signal are introduced to the gate of the transistor 60 to make the transistor conductive. This causes current to flow through a circuit including the battery 52, the light-emitting diode 62, the transistor 60 and the resistance 58.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In a combination for providing a visual display, first means having properties of being impacted against an object and of contacting the object during the impact and of withstanding each impact of the first means against the object, second means disposed in the first means and shaped to define an insert in the first means and having properties of withstanding the impact of the first means against the object, third means disposed in the second means and having properties of generating an instantaneous signal as a result of each impact of the first means against the object, fourth means disposed in the second means and having properties of withstanding each impact of the first means against the object and responsive to each signal generated by the third means for providing an illumination indicating each impact of the first means against the object, and fifth means disposed in the second means for providing energy for illuminating the fourth means in response to each signal generated by the third means, the fifth means having properties of withstanding the impact of the first means against the object.

2. In a combination as set forth in claim 1, the first means constituting the bottom of a shoe and the object constituting ground.

3. In a combination as set forth in claim 1, the fourth means constituting a light-emitting diode.

4. In a combination as set forth in claim 3, the first means constituting the heel of a shoe.

5. In combination, a member forming a part of a shoe and constructed to be impacted against the ground and to contact the ground during the impact and to withstand the impact of the member against the ground, first means disposed in the member and shaped to define an insert in the member and having properties of withstanding the impact of the member against the ground, second means disposed in the first means and having properties of withstanding the impact of the member against the ground and of generating an instantaneous signal as a result of the impact of the member against the ground, and third means disposed in the first means and responsive to the signal generated by the second means for providing an emission of light and having properties of withstanding the impact of the member against the ground, and fourth means disposed in the first means for providing energy for illuminating the third means when the second means generates the signal, the fourth means having properties of withstanding the impact of the object.

6. In a combination as set forth in claim 5, fifth means for limiting the signal from the second means to obtain an illumination of the third means by the energy from the fourth means.

7. In a combination as set forth in claim 5, the third means including a light-emitting diode and the fourth means constituting a battery.

8. In a combination as set forth in claim 7, the member constituting the heel of the shoe.

9. In a combination as set forth in claim 2, the member constituting the heel of a shoe and the heel of the shoe having a socket and the insert being disposed in the socket in the heel and having a shape corresponding to the shape of the socket.

10. In a combination as set forth in claim 2, the second means producing a current as a result of each impact of the bottom of the shoe against the ground and the third means receiving the current from the third means to provide an illumination, and fifth means for limiting the current from the third means through the fourth means.

11. In a combination as recited in claim 5, the member having a socket and the insert being disposed in the socket and having a shape corresponding to the shape of the socket.

12. In a combination as recited in claim 6, the member constituting the heel of a shoe, the second means producing an instantaneous current only as a result of each impact of the bottom of the shoe against the ground and the third means receiving the current from the second means, and fifth means for limiting the instantaneous current from the second means through the third means as a result of each impact of the bottom of the shoe against the ground.

13. In a combination as set forth in claim 12, the third means constituting a light-emitting diode.

14. In a combination as recited in claim 3, the first means constituting the bottom of a shoe and the object constituting ground, the fourth means including a light-emitting diode and the fifth means including a battery, and the third means including sixth means for limiting the signal produced by the third means.

15. In a combination as recited in claim 12, the fifth means including a battery and the fourth means including a light emitting diode.

16. In a combination as set forth in claim 4, the second means having a flat configuration and extending in the flat configuration in the horizontal direction and conforming to the configuration of the heel.

17. In a combination as recited in claim 14, the second means having a flat configuration and extending in the flat configuration along the length of the bottom of the shoe and conforming to the configuration of the bottom of the shoe.

18. In a combination as set forth in claim 8, the first means having a flat configuration and extending in the flat configuration along the length of the heel and conforming to the configuration of the heel.

19. In a combination as set forth in claim 12, the first means having a flat configuration and extending in the flat configuration along the length of the heel and conforming to the configuration of the heel.

* * * * *